United States Patent [19]

Moulton

[11] Patent Number: 4,478,112

[45] Date of Patent: Oct. 23, 1984

[54] FASTENER FEEDER

[76] Inventor: Anthony D. Moulton, 305 Melbourne, Columbia, Mo. 65201

[21] Appl. No.: 419,237

[22] Filed: Sep. 17, 1982

[51] Int. Cl.[3] ..... B25B 23/02

[52] U.S. Cl. ..... 81/57.37

[58] Field of Search ..... 81/57.37, 435, 429; 221/276, 232

[56] References Cited

U.S. PATENT DOCUMENTS 2,255,827 9/1941 Snyder ..... 81/435

2,943,652 7/1960 Chilton ..... 81/435

*Primary Examiner*—James L. Jones, Jr.

*Attorney, Agent, or Firm*—Kokjer, Kircher, Bradley, Wharton, Bowman & Johnson

[57] ABSTRACT

A feeder for power tools to permit rapid installation of fasteners such as screws, nuts or the like. The feeder includes a magazine which receives a supply of fasteners in individual holders for movement through an arcuate, tubular guide to an installation station. Means is provided to move the rotatable fastener driver into engagement with the fastener to install the latter. Subsequent withdrawal of novel spacing pins from the surface of the object results in automatic ejection of the empty fastener holder and movement of a fresh fastener and its holder into proper position for installation. The operation may be continued repeatedly to install a plurality of fasteners with each successive fastener being automatically moved in sequence to the installation position.

19 Claims, 18 Drawing Figures

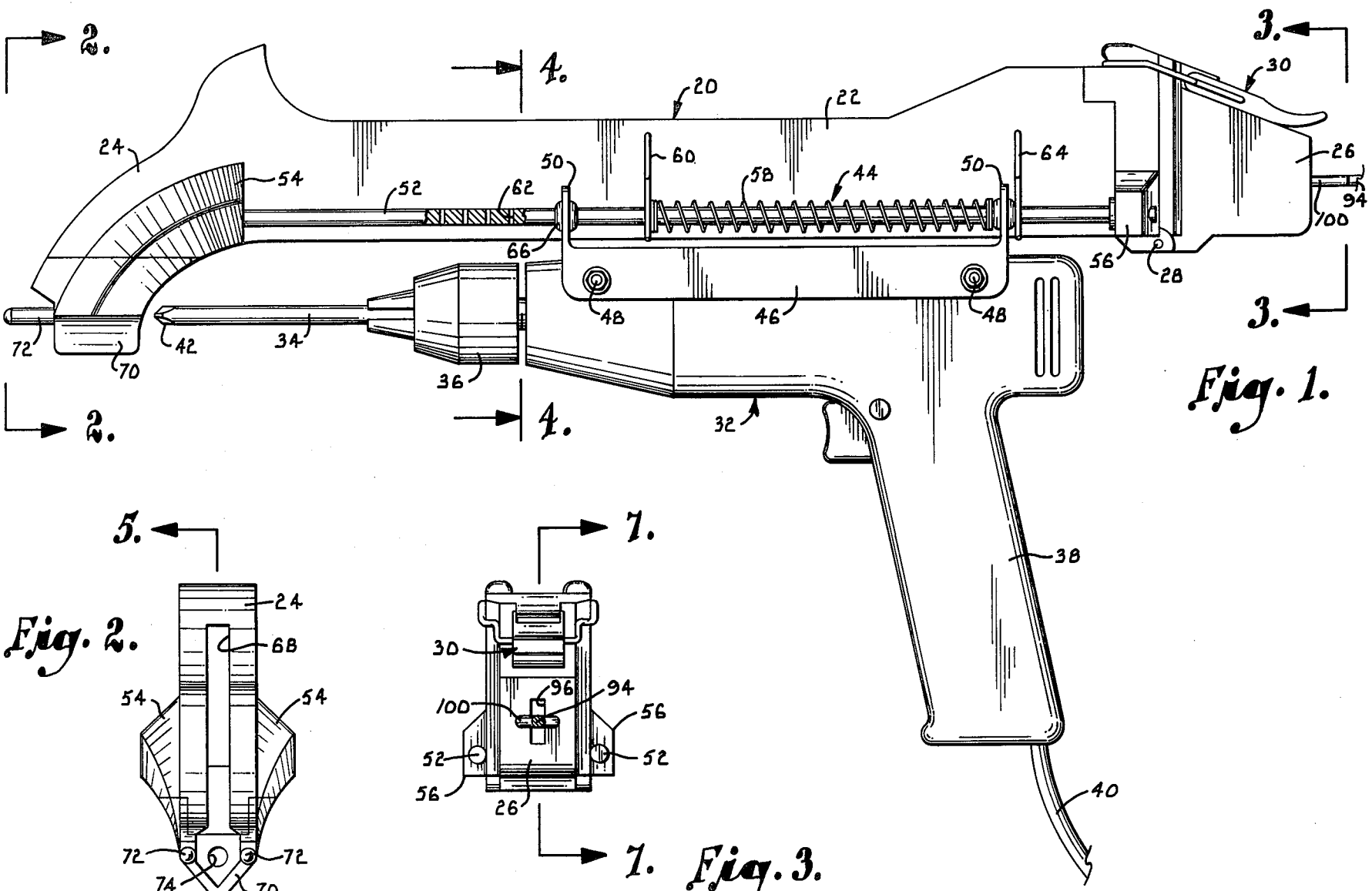
Fig. 1.
Fig. 3.
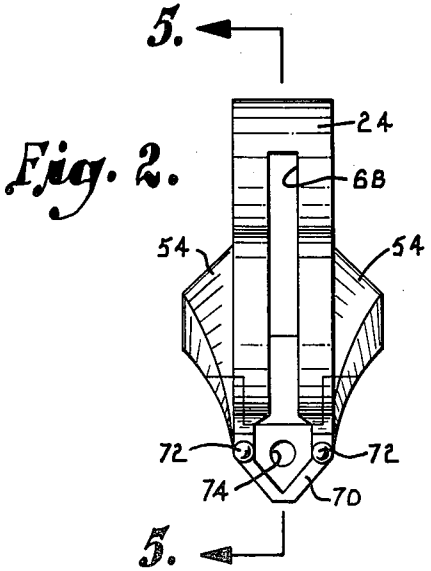
Fig. 2.

22
54
24
54
74
6.
6.

22
24
68
74
70
72

22
50
52
46
48
32
50
52

88
84
9.
9.
76
82
86
78
88

82
78
82
80

84
86
78
76
86
82

94
90
96
100
30
98
26
92
28
22

FASTENER FEEDER

This invention pertains to the installation of fasteners, and more particularly to a novel feeder for a power tool or the like to provide a continuous supply of fasteners such as screws or nuts to the tool for repeated application thereby.

Various devices have heretofore been suggested for providing a continuous supply of fasteners to an automatic machine to permit rapid application by the machine. In the main, these have been relatively large installations suitable for high speed manufacturing operations requiring a single machine to perform a single function. They are, however, entirely too expensive and unwieldly for use as an adjunct with highly versatile and often portable tools which may be required for the accomplishment of a wide variety of jobs. Prior devices of this type, insofar as applicant is aware, have generally resorted to the use of compressed air to blow the individual fasteners through some sort of tubular apparatus to the position for ultimate application. Alternatively, some such devices have resorted to the use of a specially manufactured "stick" of integrally connected fasteners wherein the entire stick is advanced incrementally to bring the fasteners sequentially into the proper position for application. Once applied, the fasteners are severed from the stick so that the work piece may be advanced for the application of a subsequent fastener from the stick.

While devices of the type referred to above serve adequately for some relatively fixed installations where versatility is not a requirement, there exists a need for the rapid, sequential supply of fasteners to relatively portable hand tools of the type required by homeowners or fabricators of various products and structures where it is impractical to utilize equipment at a fixed installation over a substantial length of time.

Accordingly, it is a primary object of the present invention to present apparatus for supplying fasteners sequentially to a fastener applying tool such as a portable hand tool, which apparatus may be employed as an attachment to the tool and may be carried therewith or which may also be used in a fixed installation if desired.

It is another important object of the invention to provide such a feeder which is constructed in a manner to permit the use of novel fastener and storage means which simplifies the continuous supply of individual fasteners to the zone of application.

Still a further object of the invention is to provide novel spring and rail structure in combination with the fastener supply apparatus and holder system wherein the combination serves to maintain proper alignment and positioning of the various components through the fastener application operation and subsequent ejection of the spent fastener holder and repositioning of a new fastener.

A further object of the invention is to provide structure of this type which utilizes a highly convenient clip and magazine storage means, obviating the need for more cumbersome pneumatic or integral stick means of supplying fasteners to the application tool.

In the achievement of the foregoing object, it is yet another object of the present invention to provide a novel holder for each individual fastener to assist in the proper positioning of the fasteners and to facilitate their movement through the device without the need for expensive and unwieldly vibratory apparatus to orient the fasteners for movement through the machine.

It is also an important object of the present invention to provide such a holder which is inexpensive to fabricate, easy to apply to the respective fasteners, and which is easy to dispose of when the fastener is removed therefrom so that the holders do not adversely affect the beneficial utilization of the fastener supply attachment.

These and other important aims and objectives of the present invention will be further explained or will become apparent from the description and explanation of the drawings, wherein:

FIG. 1 is a fragmentary side elevational view of a feeder embodying the principles of this invention shown mounted on a portable electric drill, parts being broken away and shown in cross-section to reveal details of construction;

FIG. 2 is an elevational view taken along line 2—2 of FIG. 1;

FIG. 3 is a cross-sectional view taken along line 3—3 of FIG. 1, certain parts being shown in elevation for clarity;

Figures 4, 5, 6, 7, 8, 9, 10:
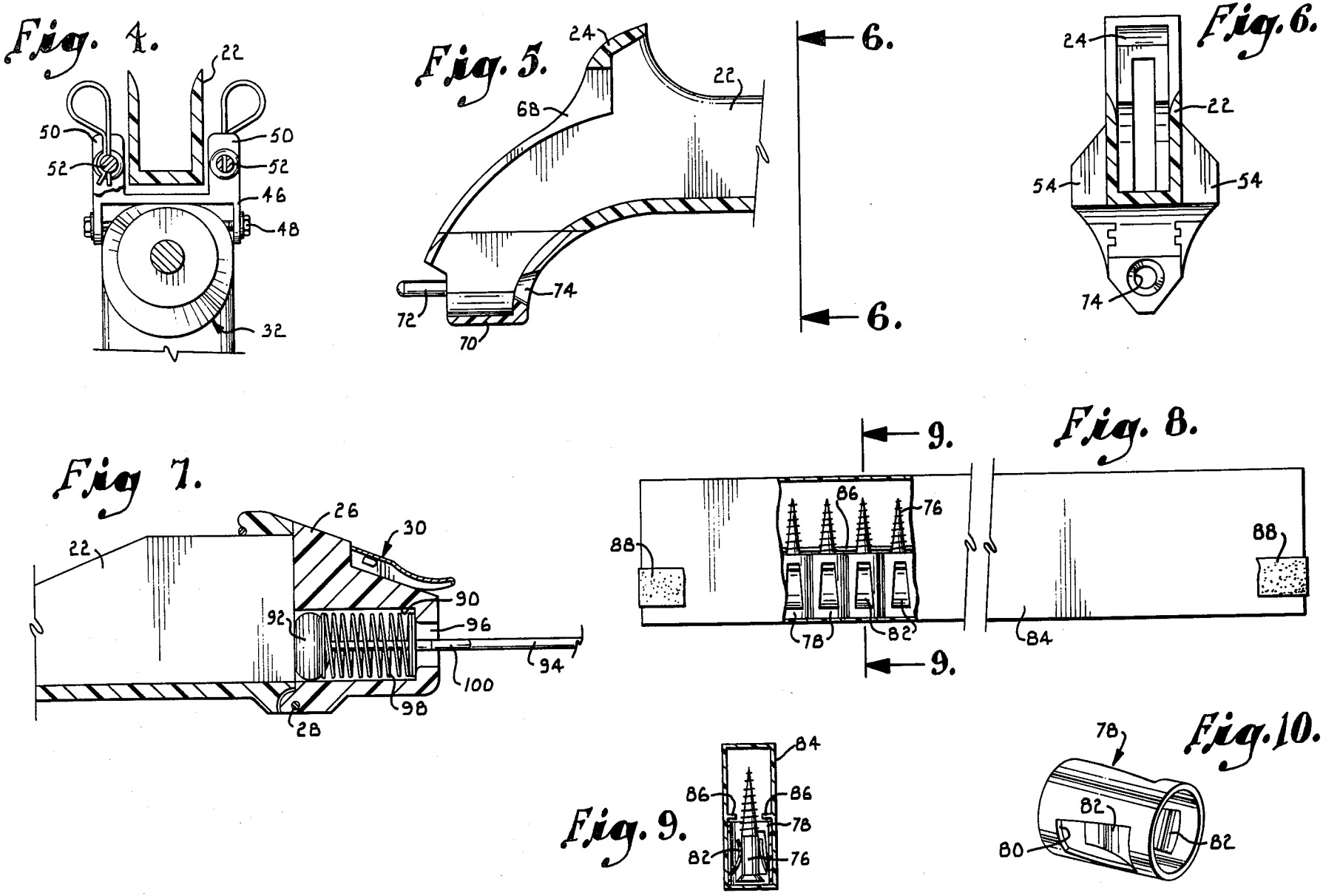
FIG. 4 is a view taken along line 4—4 of FIG. 1, certain parts appearing in elevation for clarity.
FIG. 5 is a cross-sectional view taken along line 5—5 of FIG. 2.
FIG. 6 is a cross-sectional view taken along line 6—6 of FIG. 5.
FIG. 7 is a cross-sectional view taken along line 7—7 of FIG. 3.
FIG. 8 is a fragmentary side elevational view of a clip for use with the attachment of FIG. 1, parts being broken away to show the positions of the fasteners and their associated holders in the clip.
FIG. 9 is a detailed cross-sectional view taken along line 9—9 of FIG. 8.
FIG. 10 is an enlarged perspective view of a novel fastener holder embodying the principles of this invention.

A fastener feeder attachment embodying the principles of this invention is broadly designated by the reference numeral 20 and comprises an elongated magazine section 22, a curved guide section 24 integral therewith and a cover 26 pivotally secured at the rear magazine 22 by hinge means 28. A latch 30 releasably secures cover 26 in its closed position and is openable to permit the insertion of fasteners into attachment 20 as will be more fully described hereinafter.

Attachment 20 is adapted to be mounted to a power driver or similar tool in the nature of a drill 32 capable of providing rotary torque to an elongated shaft 34 clamped in the chuck 36 of tool 32. The latter may be of conventional construction having a handle 38 for portable manipulation and equipped with an internal motor (not shown) energized by an electric cord or pneumatic hose 40. Shaft 34 has an outermost tip 42 configured to engage a fastener to rotate the latter during the application procedure. In the embodiment chosen for illustration, shaft 34 is in the nature of an ordinary philips head screw driver.

Means for mounting attachment 20 to tool 32 includes yieldable bracket and rail structure broadly designated by the reference numeral 44. Structure 44 includes a bracket 46 shown best in FIGS. 1 and 4 of the drawing. Bracket 46 extends downwardly on either side of magazine 22 into embracing relationship on each side of the upper marginal portion of tool 32. Bolt means 48 releasably secure the bracket to the tool. A pair of upwardly extending integral ears 50 on each side of magazine 22 have aligned holes therethrough to slideably receive elongated transversely circular rails in the form of rods 52. The forwardmost ends of the respective rods 52 are mounted in corresponding outwardly extending enlargements 54 on either side of the curved guide 24 (FIG. 2). The rear end of each rod 52 is mounted in outwardly extending flange 56 on each corresponding side of magazine 22 as illustrated best in FIG. 3. Such mounting maintains each rod 52 in outwardly spaced relationship from its corresponding side of the elongated magazine 22 to permit relative shifting movement between attachment 20 and tool 32. A spring 58 is received over each rod 52 and is interposed between the rear bracket ear 50 and a pin 60 inserted in an appropriate one of a series of vertically extending apertures 62 spaced longitudinally along each rod 52 so that attachment 20 is biased toward the position thereof shown in FIG. 1 of the drawings. A second pin 64 at the rear of each rod 52 is received in another appropriate aperture 62 to define the normal position for attachment 20 relative to the tool. A resilient perforated grommet 66 may be mounted in the hole of ear each 50 with the corresponding rod extending through the grommets to cushion and smooth the shifting action.

Attachment 20 may be largely constructed of molded plastic material with sections 22 and 24 connected integrally. Section 22 is of open top trough like configuration as shown clearly in FIG. 4. Guide structure 24 is of generally tubular configuration. The guide extends in an arc of approximately 90° to define a pathway for fasteners moving from the magazine to an installation position or station immediately outboard from and alignment with shaft 34 of tool 32. The curved pathway of structure 24 is configured to present a longitudinally extending slot 68 in the forwardmost wall of the guide structure as illustrated best in FIG. 2. Slot 68 is disposed to provide clearance for the projecting ends of screw like fasteners so that the latter may be moved through the guideway to the installation position.

A generally V-shaped horizontally extending barrier element 70 releasably secured to the lowermost end of guide structure 24 serves to receive the fasteners at the installation station and hold the latter in proper position aligned with the longitudinal axis of shaft 34 so that the fasteners may be installed by the tool. Spacing means in the form of a pair of rigid projecting pins 72 on either side of the fastener guideway and mounted in the front edge of barrier 70 extend forwardly from structure 24. The pins serve as spacers which may be engaged against an object which is to receive the fasteners. The pins maintain a predetermined distance between attachment 20 and the object. Although other means such as an appropriate configuration of the forward portions of the attachment could be used to provide the proper spacing, it has been found that the spaced apart pins serve well for this purpose. A tapered opening 74 in the lowermost wall of barrier element 70 is aligned with shaft 34 and permits the shaft to enter the fastener installation station above the V bottom of barrier 70 upon rearward shifting movement of attachment 20 relative to tool 32 as will be further explained hereinafter.

The fasteners to be installed by use of the attachment of this invention may be screws such as the screw 76 illustrated in FIG. 9 of the drawing. A plurality of such screws 76, which would frequently, but need not necessarily be of uniform size, are initially mounted in a cylindrical holder broadly designated by the reference numeral 78. Holder 78 is preferably formed from initially flat sheet material such as cardboard, plastic or the like. The material is provided with a plurality of U-shaped cuts 80, each cut providing a cantilevered tab 82 of the material integral with the body of holder 78 and having sufficient resiliency so that each tab 82 when deformed as shown in FIG. 10 provides a spring biasing force to hold the screw 76 in the position shown in FIG. 9. The fastener is thus supported in a vertical position in axial alignment with the cylindrical holder 78 and with tabs 82 maintaining this axial alignment. The threaded end of fastener 76 may project outwardly beyond one end of the holder as shown.

Each fastener is thus retained in its respective holder 78 and a plurality of holders having the same diameters and containing fasteners are packaged in side by side abutting relationship in an elongated transversely retangular clip 84 best illustrated in FIGS. 8 and 9. To accommodate the particular fasteners and holders illustrated, clip 84 has a longitudinally extending, inwardly projecting rib 86 on each side wall thereof and each rib is positioned to overlie a portion of the upper end edge of each holder 78 when the holders are positioned in the clip. The slot between the inwardly projecting ribs 86 receives the projecting ends of fastener 76 as illustrated clearly in FIGS. 8 and 9. The ends of clip 84 are open to permit the passage of the fasteners through the clip. The clip ends may be temporarily closed during storage of the filled clips by easily destructable means such as a strip of ruptureable tape 88 or the like as shown in FIG. 8.

Referring now particularly to FIG. 7 of the drawings, cover 26 has a longitudinally extending bore 90 aligned with the internal cavity of magazine 22. A follower in the form of a knob 92 is secured on the end of an elongated element such as a rod 94 which projects rearwardly and outwardly from the cover through a slot 96 at the rearmost end of bore 90. A spring 98 is interposed between follower 92 and the rear wall of cover 26 to bias the follower toward the front of attachment 20. Enlargement 100 on rod 94 projects laterally from the latter and serves to hold the follower in the position shown in FIG. 7 when rod 94 is rotated to the position shown in FIG. 3. In such position enlargement 100 cannot pass through slot 96. A handle (not shown) on the outermost end of rod 94 facilitates the rotation of the rod so that enlargement 100 may be aligned with slot 96 to permit spring 98 to move the follower forwardly.

Figure 11:
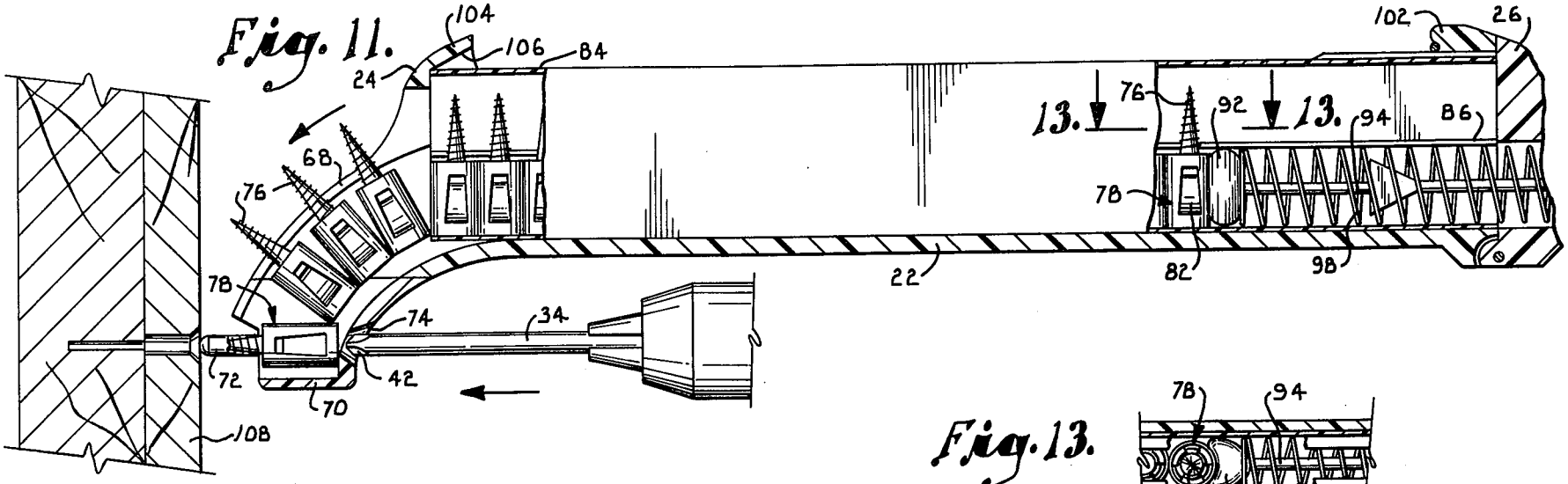
FIG. 11 is a fragmentary side elevational view of a tool and attachment with a filled clip in the magazine, and a structure to be fastened showing the parts just prior to the engagement of the tool with a fastener, parts being broken away and shown, in cross-section to reveal details of construction.
Figure 13:
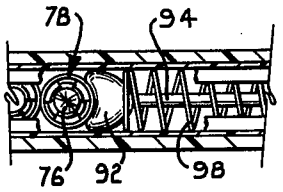
FIG. 13 is a cross-sectional view taken along line 13—13 of FIG. 11.

In the operation of the embodiment of the apparatus described to this point, a clip 84 containing fasteners 76 in holder 78 such as illustrated in FIG. 8, is loaded into the magazine section of the attachment. This is accomplished by releasing latch 30 and swinging cover 26 on its hinge. The clip slides into the magazine section from the rear and is held in proper position by a rear abutment 102 and a front abutment 104 shown best in FIG. 11 of the drawings. The rearwardly directed face 106 of abutment 104 is inclined so that the clip is guided to its proper position in the magazine. Tape 88 on the ends of the clip may be easily ruptured by a slight push with the finger or they may be fabricated of such material that they will rupture under the force of spring 98. Rod 94, which is initially locked in its rearwardmost position shown in FIG. 7 of the drawings, is rotated 90° to permit knob 92 to be urged forwardly by the bias of spring 98. Knob 92 is preferably configured as shown best in FIG. 13 so that it complementally engages the rearmost holder 78. The action of spring 98 now forces the leading holders 78 and their respective fasteners 76 forwardly and downwardly along the arcuate guide path until the forwardmost holder rests on the V-shaped barrier as is illustrated in FIG. 11.

The operator may now engage pins 72 against and object to receive the fasteners, such as object 108 shown in the drawing. When the pins 72 engage the object, forward thrusting of the apparatus by the operator pushes shaft 34 through opening 74 and brings tip 42 into operative engagement with the head of the fastener. The motor is energized to rotate the shaft 34. Simultaneous pushing and rotating forces both the holder and its fastener forwardly toward object 108 until the forwardmost end of the holder comes into engagement with the object surface. It should be pointed out at this juncture that the spacing between the forwardmost end of guide 24 and the object due to the pin length is insufficient to permit the holder to move from its position of alignment with shaft 34 when the pins are engaged against the object surface.

Figure 12:
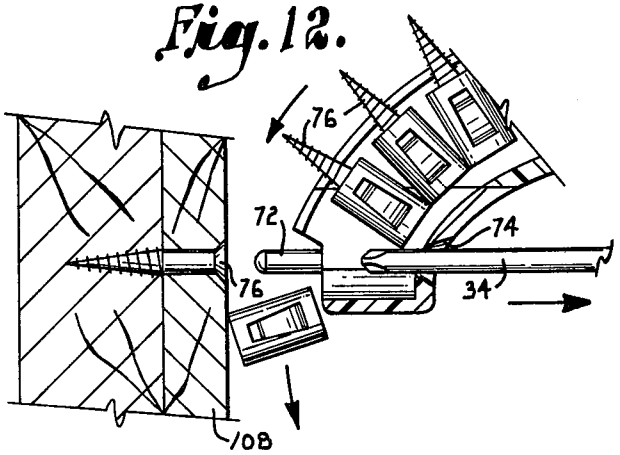
FIG. 12 is a fragmentary view similar to FIG. 11 but showing the relative positions of the parts upon retraction of the attachment following installation of a fastener.

Continued rotation of shaft 34 results in the installation of the fastener into the object. Once the fastener is properly installed, the operator withdraws the tool moving pins 72 from the object surface and providing sufficient space between the forwardmost end of barrier 70 and the surface for the now empty holder to gravitate from the installation station as shown in FIG. 12 of the drawings. It is, of course, apparent that the configuration of the outlet opening defined by the guide section and barrier 70 contributes to the desired retention of the holder at the installation station until the attachment is withdrawn from the object surface whereupon the spent holder is automatically discharged.

The withdrawal of the tool and its attachment 20 from the object surface permits springs 58 of mounting structure 44 to shift the attachment forwardly with respect to the tool, resulting in the withdrawal of shaft 34 through opening 74. Once the tip of shaft 34 is withdrawn from the guide, the biasing force of spring 98 forces another fastener and its holder into the installation station for subsequent installation as heretofore been described.

The process of sequential installation of the fasteners from the clips may be repeated in this manner until the clip is emptied. At that time, the operator need only release latch 30, swing cover 26 aside, remove the spent clip, install a fresh clip and replace the cover for continued operation of the apparatus. The cross-sectional measurement of the respective holders 78 are substantially uniform and are complementally received within the guide in a manner to assure smooth and uninterupted movement of the fasteners from their initially upright positions through an arc of approximately 90° to the installation station as the holders pass through the arcuate guide. Further, the longitudinal dimensions of the respective holders are also substantially uniform to contribute to this smooth movement and also to permit the automatic ejecting of a spent holder and the subsequent movement of a successive holder and its fastener to the installation position.

Figure 14:
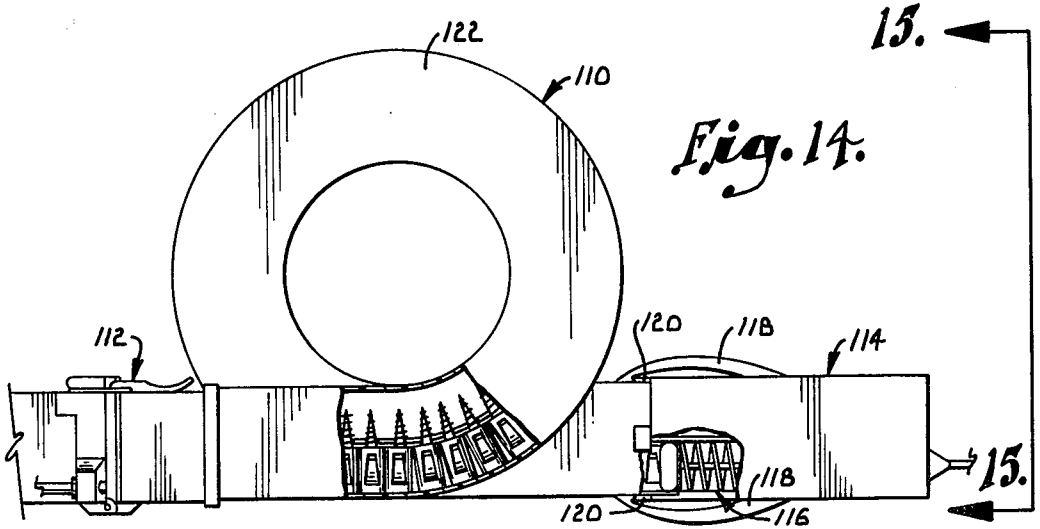
FIG. 14 is a fragmentary top plan view on a reduced scale of an alternate form of fastener supply container.

It is within the spirit of the present invention to provide for those fastener installation tasks wherein it may be desirable to increase the quantities of fasteners which may be installed with the attachment without stopping to reload clips at frequent intervals. An alternate magazine construction for this purpose is illustrated in FIG. 14 of the drawings. A magazine extension broadly designated by the reference numeral 110 of generally spiral construction is illustrated in this figure and is constructed as a replacement for cover 26 at the rear of attachment 20. Extension 110 is hinged to the attachment and includes a latch 112 to permit the extension to be opened at this point for removal of fasteners or maintainence of the apparatus as may be required. A cover 114 constructed similarly to cover 26 and containing a follower 116 as illustrated in the drawing is provided to be attached to the rear end of extension 110. Cover 114 might be hingedly connected to the extension but, in the embodiment illustrated, cover 114 is provided with integral resilient hooks 118 adapted to cooperate with abutments 120 on either side of the extension to provide a releasable latch for installation or removal of cover 114.

Figure 15:
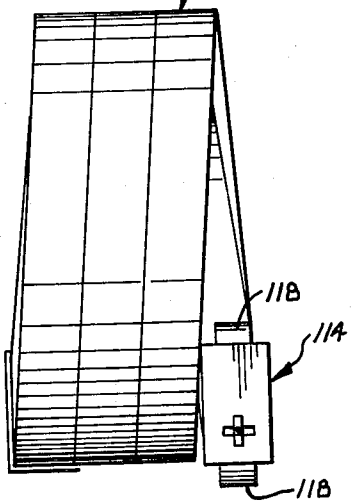
FIG. 15 is an elevational view taken along line 15—15 of FIG. 14.

The fasteners and holders may be preloaded into extension 110 to provide a substantial supply of fasteners. The capacity of attachment 110 could be increased by extending the length of the curvilinear guide section 122 to whatever might be desired depending upon the weight and size limitations imposed by job requirements and the preference of the operator. The interior of extension 110 is constructed similarly to the interior of clip 84 to present a pair of inwardly projecting ribs overlying the respective holders presenting a guide slot through which the respective projecting fasteners move through the extension. The radius of curvature of the extension is choosen to permit smooth and unobstructed movement of the fasteners and holders in sequence under the influence of the spring and follower construction in cover 114. FIG. 15 of the drawings illustrates clearly how extension 110 may be constructed with a plurality of convulutions of the extension to provide a substantial quantity of fasteners.

Figure 16:
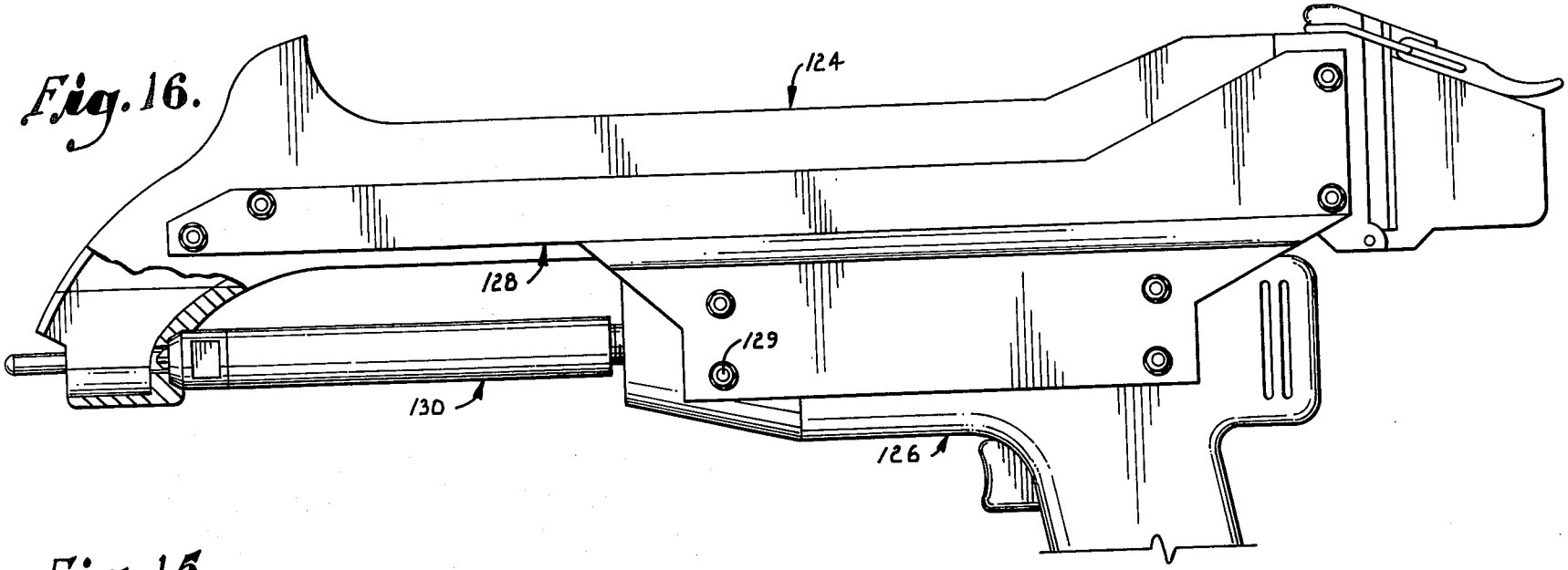
FIG. 16 is a fragmentary view similar to FIG. 1, but showing an alternate construction for obtaining relative shifting movement between the tool and the attachment to bring the tool into engagement with a fastener and to return the tool to a standby position for the supply of a subsequent fastener to the aligned position.
Figure 17:
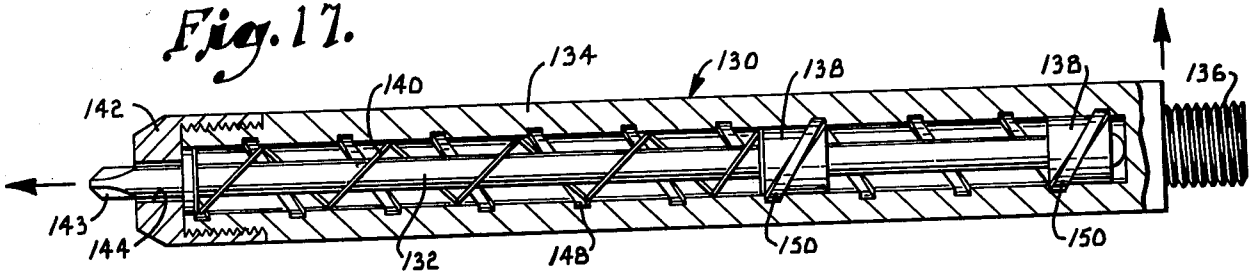
FIG. 17 is a vertical, cross-sectional view through a bit advancing mechanism of the assembly of FIG. 16.
Figure 18:
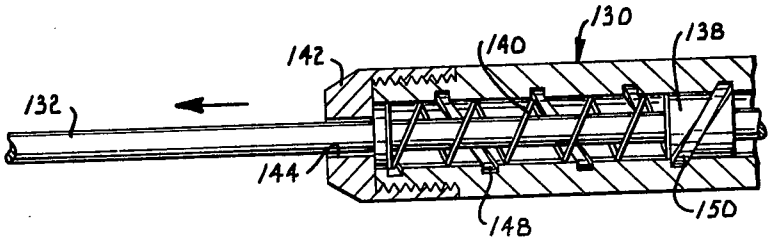
FIG. 18 is a fragmentary view similar to FIG. 17, but showing the relative position of the parts as the tool is operated to advance the fastener rotating bit.

The embodiment of the invention illustrated in FIGS. 16, 17 and 18 of the drawings is in the form of an attachment broadly designated by the reference numeral 124 which does not require the rail and guide mounting structure provided for apparatus 20 to achieve the necessary relative movement for operation of the attachment. Attachment 124 is generally identical to attachment 20 previously described except for the means by which it is mounted to a tool 126 and provision for the projecting shaft structure of the tool located at the attachment installation position as shown in FIG. 16.

Attachment 124 is rigidly secured to tool 126 by a pair of fixed mounting brackets 128, one for each side of the tool respectively. Brackets 128 are secured to the tool and attachment by bolt means 129 and no relative movement between the tool and the bracket is provided in this construction.

The relative movement necessary to bring the rotating tool tip into and out of operative engagement with the respective fasteners is provided by a shifting device broadly designated by the reference numeral 130. Device 130 includes an elongated transversely circular shaft 132 received in telescoped relationship within a tubular housing member 134 having a threaded end 136 adapted to be coupled with the tool 126 as a replacement for the conventional tool chuck. A pair of spaced apart bushing members 138 are integral with shaft 132 and are received within the internal bore 146 of housing 134 for longitudinal shifting movement along the bore. A spring 140 is interposed between the forwardmost member 138 and the nose plug 142 threaded on the forward end of member 134 as illustrated in FIG. 17. A projecting end of shaft 132 having a fastener engagable tip 143 is received through an axially opening 144 in the nose plug. A continuous spiral groove 148 in member 134 opens onto bore 146 and extends the length of the tubular member. Threads 150 on bushings 138 are constructed to be complementally received within the groove so that relative rotation between the tubular member and the shaft results in longitudinal movement of the shaft with respect to the member as will be readily understood by those skilled in the art. The hole in fastener guide of attachment 124 immediately to the rear of the installation position is configured to accept the forwardmost end of device 130 and permit the rotation thereof as shown best in FIG. 16.

The operation of attachment 124 is generally similar to that heretofore described with respect to attachment 20. In this case, it is not necessary for the operator to push the tool to effect relative shifting movement between the attachment and the tool. After the operator has placed the spacer pins against the object receiving the fastener, the tool is energized to rotate tubular member 134 of device 130. Inertia of shaft 132 results in relative rotation between the shaft and the tubular member causing the shaft to be advanced forwardly into engagement with the fastener at the installation station. Drag of the fastener increases such relative rotation resulting in continued forward shifting movement of the shaft as the latter is rotated to drive the fastener into its installed position. Once the driving torque is interrupted, the bias of spring 140 returns the shaft to its position telescoped within member 134. The fastener holder is, of course, permitted to gravitate from the end of the attachment following installation of the fastener and upon withdrawal of the tool in the manner described with respect to attachment 20. Further, withdrawal of the shaft to its telescoped position permits a subsequent fastener and holder to be advanced by the spring and follower of the attachment to the installation position. Successive fasteners may be repetitively installed by this embodiment of the device by following the steps described.

While the inventions set forth herein have been described specifically with respect to the application of fasteners taking the form of elongated screws, there is no intention to limit the scope of the invention to use with fasteners of this type. On the contrary, other fasteners having different shapes such as internally threaded nuts or the like can be installed with attachments embodying the principles of the invention. Some fasteners might be shaped in a manner which would not require any packaging in cylindrical fastener holders and the concepts of the invention are to be considered of sufficient scope to embrace the use of the feeder to install fasteners of this type.

Further, it is within the contemplation of this invention that a plurality of individually dissimilar fasteners might be packaged together in any predetermined sequence for handling by the feeder as required for a particular task or sequence of tasks. The outermost end or barrier 70 of the feeder may be removed and replaced with a generally similar barrier configured specifically to accommodate the shape of other fasteners if required. Obviously, the tool drive bit can be easily changed to conform with the shape of the particular fasteners being handled by the apparatus. Thus, a wide variety of fastener shapes and sizes can be utilized, it being only necessary that the diameters of the holders be uniform unless the shape of the fastener should dictate that the barrier or the drive bit or both should be changed.

I claim:

1. A feeder to supply rotary applied fasteners to a tool having an elongated, rotatable fastener applying shaft equipped with a fastener driving tip, said feeder comprising:

an elongated fastener supply magazine configured to receive a plurality of fasteners therein with the fasteners oriented in a direction different from the axis of rotation of said shaft;

guide means communicating with the magazine to conduct each fastener in sequence into a position aligned axially of said shaft and beyond said tip, the guide means including means for releasably holding the fasteners in said position and structure defining a pathway of predetermined size extending from the magazine to said position;

a holder for each fastener, each holder being configured to engage its respective fastener to releasably retain the fastener in the holder and the holders having at least one uniform dimension fitting complementally within the pathway whereby to enhance a uniform movement of the fasteners through the guide means;

spring means in the magazine and disposed to bias the fasteners to move to said position; and means on the feeder for mounting the latter to the tool, said mounting means including structure to permit relative movement between the feeder and the tool in the direction of the shaft axis whereby pushing the tool with the feeder engaging an object moves the tip relative to a fastener to engage the tip with the fastener to rotatably install the latter.

2. The invention of claim 1, wherein the holders are tubular, each fastener being frictionally engaged in the interior of its respective holder, each holder having the same transverse cross-sectional dimension as the other holders.

3. The invention of claim 2, wherein the fasteners are elongated, each fastener being received within its respective holder and projecting from one end thereof, and wherein said guide structure includes an elongated slot extending the length thereof, said slot being disposed to receive the projecting portions of said fasteners to permit passage of the interengaged fasteners and holders through the guide means to said position.

4. The invention of claim 2, wherein each tubular holder includes integral spring means projecting into the axial bore thereof in disposition to frictionally engage said fastener to releasably retain the latter engaged with said holder.

5.The invention of claim 1, wherein said pathway is arcuate to alter the direction of orientation of each holder and its corresponding fastener as the holders move from the magazine to the position.

6. The invention of claim 5, wherein said arc of said pathway subtends an angle of approximately 90° , whereby the fasteners are rotated approximately 90° during movement through the guide means.

7. The invention of claim 1, wherein said guide structure includes a barrier at the outermost end of said pathway, said barrier being disposed to restrict the movement of said holders past said position aligned with the tool shaft, said guide structure including an aperture on the side of the structure adjacent the outermost end of the shaft to receive the latter for rotating the fastener, and an opening on the side of said structure opposite the aperture, said opening being of sufficient size to permit passage of the holders therethrough for discharge from the attachment.

8. The invention of claim 7, wherein said barrier is configured to define an elongated, V-shaped trough disposed to receive a holder and maintain its corresponding fastener in axial alignment with the shaft when a holder is positioned at said station.

9. The invention of claim 7, wherein is included rigid spacer means carried by the attachment and adapted to engage an object to receive a fastener, said spacer means including a bumper projecting beyond said guide structure for a distance insufficient to provide space between the structure and said object for discharge of a holder whereby the holder and its engaged fastener is retained at said position until the attachment is withdrawn from said object.

10. The invention of claim 1, wherein said mounting means includes a rail secured to the feeder, and a bracket having a pair of slides operably coupled with the rail for rectilinear sliding movement therealong, said bracket being adapted for securing to said tool, and spring means operably associated with the rail and bracket for yieldably biasing the latter toward one end of its path of travel along the rail.

11. The invention of claim 10, wherein is provided a pair of rails, there being one for each side of said attachment, and wherein said bracket includes a pair of slides for each rail respectively.

12. The invention of claim 1, wherein is included an elongated clip having a bottom and a pair of side walls, said clip being adapted to receive a plurality of fastener containing holders in side by side relationship with one end of each holder engaging said clip bottom and the sides of said holders engaging the sidewalls of the clips and means at each end of the clip for releasably retaining the holders and fasteners therein, said clip being releasably received in said magazine.

13. The invention of claim 12, wherein said releasable means includes a strip of tape for each clip end respectively, said strips being destructable to permit selective sequential ejectment of the holders and fasteners from one end of the clip.

14. The invention of claim 12, wherein said spring biasing means includes a follower carried by the magazine, and a spring operably engaging said follower to urge the latter in the direction of movement of said fasteners toward said axially aligned position, said follower being configured to pass through the clip to force the holders from, the magazine and toward said position.

15. The invention of claim 12, wherein said magazine has an access opening to permit installation and removal of the clip, and wherein is included a cover for the opening, said cover being pivotally secured to the magazine for swinging to and from a position covering said opening, and releasable latch means to hold said cover in said covering position.

16. The invention of claim 12, wherein said clip includes a rib for each side wall respectively, each rib projecting inwardly from its side wall in disposition to partially overlie the upper end of a holder in the clip to aid in positioning the holder, the innermost edges of the ribs being spaced apart to present a slot for passage of fasteners through the clip.

17. Apparatus for repetitive rotary installation of individual fasteners comprising:

a power driver having a rotary output;

a feeder carried by the driver, said feeder including a magazine for the storage of a plurality of fasteners, guide means communicating with the magazine for conducting fasteners in sequence to an installation position, and spring means operably associated with the magazine for urging the fasteners toward said position;

said drive including a shaft operably coupled with the driver output for rotation thereby and including a fastener engagable tip; and shifting means operably associated with the driver and said shaft for imparting shifting movement of said tip longitudinally of the shaft toward and away from said station responsive to operation of the driver, whereby to move the tip into and out of engagement with the fasteners at said station, said shifting means including a tubular member operably coupled with said driver, said shaft being telescoped in said member, and thread means on the member and said shaft respectively, said thread means being operable to shift the shaft longitudinally of its axis to project outwardly o the member responsive to relative rotation in one direction between the member and the shaft.

18. The invention of claim 17, wherein is included spring means between the member and the shaft, said spring means being operable to return the shaft to its telescoped position within the member upon the release of torque from the driver tending to cause said relative rotation in said one direction.

19. A feeder to supply rotary applied fasteners to a tool having an elongated, rotatable fastener applying shaft equipped with a fastener driving tip, said feeder comprising:

an elongated fastener supply magazine configured to receive a plurality of fasteners therein with the fasteners oriented in a direction different from the axis of rotation of said shaft;

guide means communicating with the magazine to conduct each fastener in sequence into a position aligned axially of said shaft and beyond said tip, the guide means including means for releasably holding the fasteners in said position;

spring means in the magazine and disposed to bias the fasteners to move to said position; and means on the feeder mounting the latter to the tool, said mounting means including structure to permit relative movement between the feeder and the tool in the direction of the shaft axis whereby pushing the tool with the feeder engaging an object moves the tip relative to a fastener to engage the tip with the fastener to rotatably install the latter, said mounting means further including a rail secured to the feeder, and a bracket having a pair of slides operably coupled with the rail for rectilinear sliding movement therealong, said bracket being adapted for securing to said tool, and spring means operably associated with the rail and bracket for yieldably biasing the latter toward one end of its path of travel along the rail.

* * * * *